US009273895B2

(12) United States Patent
Takeuchi et al.

(10) Patent No.: US 9,273,895 B2
(45) Date of Patent: Mar. 1, 2016

(54) OUTDOOR UNIT OF AIR-CONDITIONING APPARATUS

(71) Applicant: Mitsubishi Electric Corporation, Tokyo (JP)

(72) Inventors: Yuto Takeuchi, Tokyo (JP); Hidetaka Yamauchi, Tokyo (JP); Toshiyuki Kubono, Tokyo (JP); Kazuhiro Ooishi, Tokyo (JP); Kazuho Itou, Tokyo (JP); Tomoya Yanase, Tokyo (JP); Hiroshi Iwazaki, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 93 days.

(21) Appl. No.: 14/070,724

(22) Filed: Nov. 4, 2013

(65) Prior Publication Data

US 2014/0165640 A1 Jun. 19, 2014

(30) Foreign Application Priority Data

Dec. 13, 2012 (JP) ..... 2012-272564

(51) Int. Cl.
*F25D 21/14* (2006.01)
*F24F 13/22* (2006.01)
(Continued)

(52) U.S. Cl.
CPC . *F25D 21/14* (2013.01); *F24F 1/06* (2013.01); *F24F 1/46* (2013.01); *F24F 13/222* (2013.01); *F24F 2011/0089* (2013.01); *F24F 2013/225* (2013.01); *F24F 2221/34* (2013.01)

(58) Field of Classification Search
CPC ..... F25D 21/14; F24F 13/222; F24F 1/06; F24F 1/146; F24F 2011/0089; F24F 2013/225; F24F 2221/34
USPC ..... 62/275, 324.1
See application file for complete search history.

(56) References Cited

U.S. PATENT DOCUMENTS 4,261,418 A * 4/1981 Helt et al. ..... 165/134.1
6,065,299 A * 5/2000 Chen ..... 62/277
(Continued)

FOREIGN PATENT DOCUMENTS

JP 63-69926 U 5/1988
JP 2004-150730 A 5/2004
(Continued)

OTHER PUBLICATIONS

Abstract od JP 2008096018(A) to Junichi et al dated Apr. 24, 2008.*
(Continued)

*Primary Examiner* — Mohammad M Ali
(74) *Attorney, Agent, or Firm* — Posz Law Group, PLC; David Posz

(57) ABSTRACT

[Object] To prevent a fastening member such as a bolt from being exposed from a bottom plate when a heater is fixed to the bottom plate using a heater fixture.
[Solution] An outdoor unit 100 of an air-conditioning apparatus includes a bottom plate 4, a heat exchanger 10 mounted on the bottom plate 4, and a fan 11 sending air to the heat exchanger 10. The outdoor unit 100 includes a heater 12 provided on the bottom plate 4; a fan retaining portion 20, mounted on the bottom plate 4, for retaining the fan 11; and a heater fixture 40, mounted on the fan retaining portion 20, for fixing the heater 12 by pressing the heater 12 against the bottom plate 4 from above.

3 Claims, 7 Drawing Sheets

(51) Int. Cl.

| | |
|---|---|
| ***F24F 1/06*** | (2011.01) |
| ***F24F 1/46*** | (2011.01) |
| *F24F 11/00* | (2006.01) |

(56) References Cited

U.S. PATENT DOCUMENTS

| | | | | |
|---|---|---|---|---|
| 6,718,786 | B1 * | 4/2004 | Hille et al. | 62/279 |
| 7,266,968 | B2 * | 9/2007 | Huang | 62/285 |
| 2005/0132737 | A1 * | 6/2005 | Jeon | 62/298 |
| 2006/0118274 | A1 * | 6/2006 | Lee et al. | 165/58 |
| 2006/0278084 | A1 * | 12/2006 | Kim | 96/140 |
| 2009/0038328 | A1 * | 2/2009 | Piccione | 62/291 |
| 2010/0170282 | A1 * | 7/2010 | Kim et al. | 62/276 |
| 2011/0185763 | A1 * | 8/2011 | Wakashima et al. | 62/434 |

FOREIGN PATENT DOCUMENTS

| | | | | | |
|---|---|---|---|---|---|
| JP | 2008-96018 | A | * | 4/2008 | F24F 5/00 |
| JP | 2010-091140 | A | | 4/2010 | |
| JP | 2011-252642 | A | | 12/2011 | |

OTHER PUBLICATIONS

Translation of JP 2008096018 to Junichi et al dated Apr. 24, 2008.*
Office Action issued Nov. 23, 2015 in the corresponding CN application No. 201310676955.4 (with English translation).

* cited by examiner

OUTDOOR UNIT OF AIR-CONDITIONING APPARATUS

TECHNICAL FIELD

The present invention relates to an outdoor unit, of an air-conditioning apparatus, including a heater on a bottom plate.

BACKGROUND ART

In a heat pump type air-conditioning apparatus, during a heating operation, frost may occur on an outdoor heat exchanger which serves as an evaporator. Heat exchange is inhibited by the frost. Thus, when frost is detected, a defrost operation is performed for removing the frost. When the defrost operation is performed, the frost formed on the outdoor heat exchanger is melted, dropped as drain water onto a base of an outdoor unit, and then discharged through a drain discharge hole to the outside. In some cases, in a cold climate area, frost easily occurs, and drain water dropped on a bottom plate of an outdoor unit refreezes at a low outside air temperature before discharged from the drain discharge hole. Thus, there are some outdoor units in which a heater for removing frozen drain water is provided at a bottom plate.

There is a method of fixing the heater to the bottom plate of the outdoor unit by fastening the heater thereto using a heater fixture through bolts (e.g., see Patent Literature 1). Specifically, in Patent Literature 1, a heater fixture has, at one end side thereof, a recess surrounding an outer peripheral surface of the heater from above, and has, at the other end side, a flat surface fixed to the bottom plate. The flat surface of the heater fixture is fixed to the bottom plate using fastening members such as bolts, whereby the heater is fixed to the bottom plate.

CITATION LIST

Patent Literature

[Patent Literature 1] Japanese Unexamined Patent Application Publication No. 2010-91140

SUMMARY OF INVENTION

Technical Problem

However, when the heater fixture is fixed to the bottom plate using the fastening members as in Patent Literature 1, an end of each fastening member is exposed and protrudes from the lower side of the bottom plate. Thus, there is a problem that a finger of a worker may come into contact with the bolt end, for example, during conveyance.

The present invention has been made in order to solve the above-described problems, and it is an object of the present invention to provide an outdoor unit of an air-conditioning apparatus which is able to prevent an end of a fastening member from being exposed to the outside of the outdoor unit when a heater fixture is fixed to a bottom plate.

Solution to Problem

An outdoor unit of an air-conditioning apparatus of the present invention includes a bottom plate; a heat exchanger mounted on the bottom plate; and a fan sending air to the heat exchanger. The outdoor unit includes: a heater provided on the bottom plate; a fan retaining portion, mounted on the bottom plate, for retaining the fan; and a heater fixture, mounted on the fan retaining portion, for fixing the heater by pressing the heater against the bottom plate from above.

Advantageous Effects of Invention

According to the outdoor unit of the air-conditioning apparatus of the present invention, since the heater fixture is fixed to the fan retaining portion mounted on the bottom plate, a fastening member such as a bolt is not exposed from the bottom plate in fixing the heater fixture to the bottom plate, and it is possible to reliably prevent a finger of a worker from coming into contact with an end of the fastening member during conveyance of the outdoor unit or at the time of an installation operation of the outdoor unit, and to improve the working efficiency.

DESCRIPTION OF EMBODIMENTS

Figure 1:
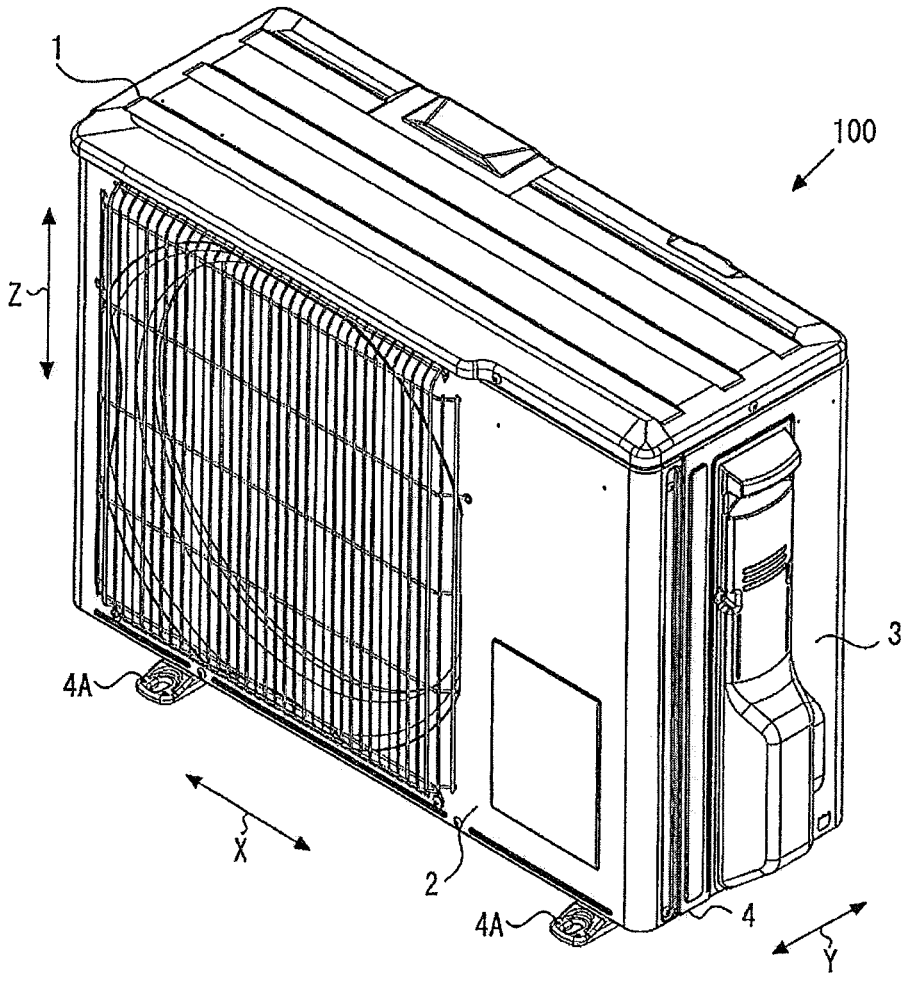
FIG. 1 is an external perspective view showing a preferred embodiment of an outdoor unit of an air-conditioning apparatus of the present invention.

Hereinafter, embodiments of an outdoor unit of an air-conditioning apparatus of the present invention will be described in detail with reference to the drawings. FIG. 1 is an external perspective view showing an embodiment of the outdoor unit of the air-conditioning apparatus of the present invention. The outdoor unit 100 of the air-conditioning apparatus in FIG. 1 is surrounded by a top panel 1, a front panel 2, side panels 3, a bottom plate 4, and the like, and leg portions 4A for fixing the outdoor unit 100 at an installation location are provided at the bottom plate 4.

Figure 2:
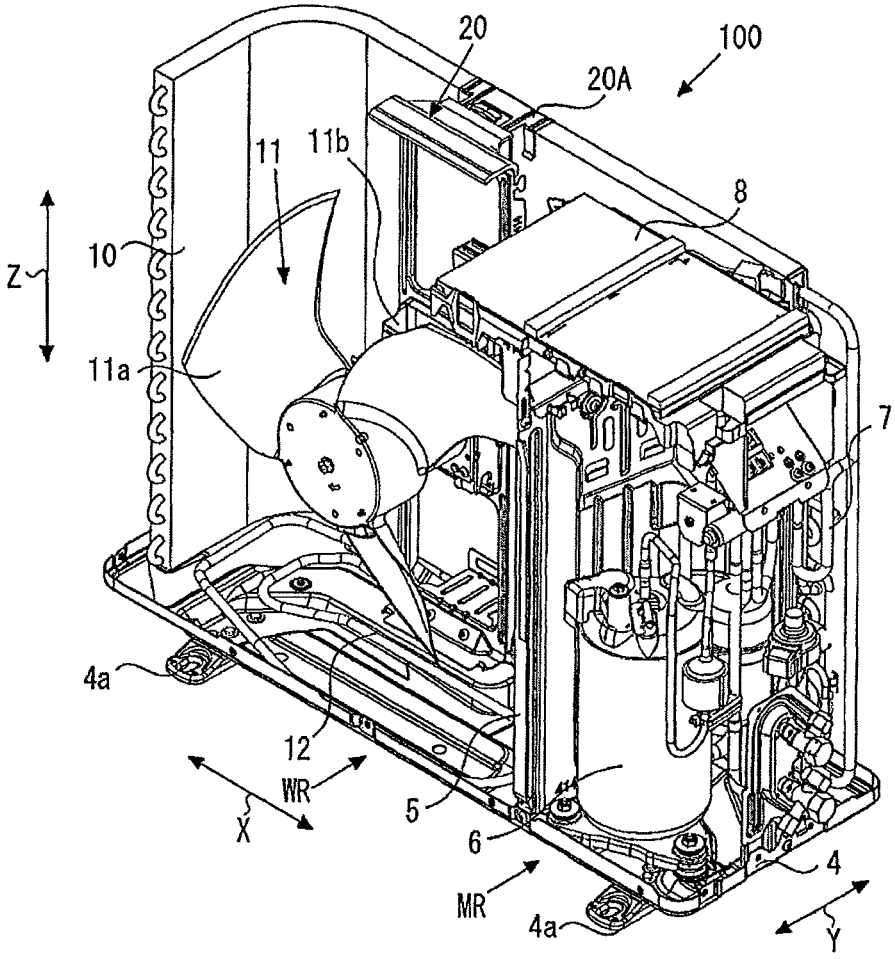
FIG. 2 is a schematic perspective view showing an example of the interior of the outdoor unit in FIG. 1.
Figure 3:
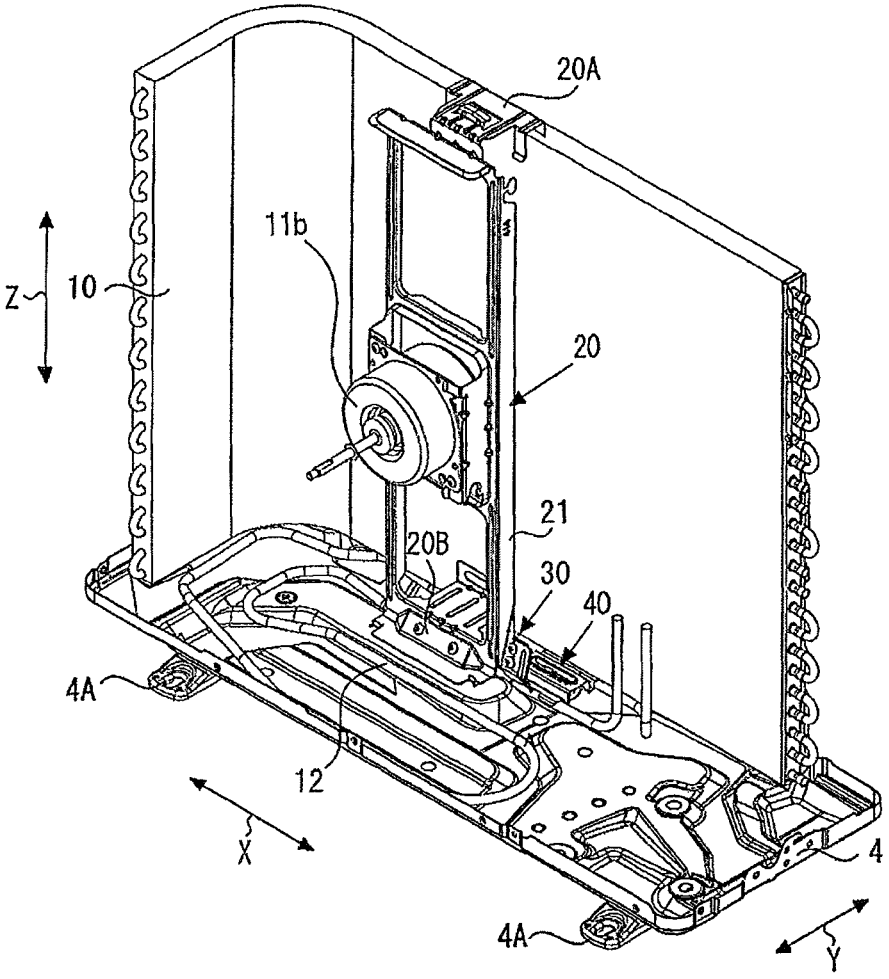
FIG. 3 is an external perspective view showing a region around a heater fixture and a fan retaining portion in the outdoor unit in FIG. 2.

FIG. 2 is a schematic perspective view showing the interior of the outdoor unit 100 in FIG. 1, and FIG. 3 is a perspective view showing a region around a heater and a fan retaining portion in the outdoor unit 100 in FIG. 2. As shown in FIGS. 2 and 3, the interior of the outdoor unit 100 is partitioned into a fan room WR and a machine room MR by a separator 5. A compressor 6, a refrigerant pipe 7, an electrical component box (control box) 8, and the like are disposed in the machine room MR, and a heat exchanger 10, a fan 11, and the like are provided in the fan room WR. It should be noted that the compressor 6 and the heat exchanger 10 are mounted on the bottom plate 4.

The compressor 6 sucks a refrigerant, compresses the refrigerant into a high-temperature and high-pressure state, and transfers the refrigerant to a refrigerant circuit via a refrigerant pipe 7. The electrical component box (control box) 8 contains control means for controlling an operation of the outdoor unit 100. The heat exchanger 10 exchanges heat between the ambient air and the refrigerant, serves as an evaporator during a heating operation, and serves as a condenser during a cooling operation. In addition, the heat exchanger 10 includes, for example, a heat-transfer pipe through which the refrigerant is passed and a fin for increasing the heat-transfer surface area between the ambient air and the refrigerant flowing through the heat-transfer pipe, and is formed in a so-called L shape having a flat plate region and a curved surface region. It should be noted that the case is illustrated in which the heat exchanger 10 is formed in an L shape, but the heat exchanger 10 may be formed in a flat plate shape or may be formed in a so-called substantially U shape having curved surface regions at both ends.

The fan 11 sends air to the heat exchanger 10 and includes a propeller 11*a* and a motor 11*b* which rotationally drives the propeller 11*a*. The propeller 11*a* is mounted on a rotary shaft of the motor 11*b*, and the motor 11*b* is retained by a fan retaining portion 20. Here, the fan retaining portion 20 includes a support 21 extending in the vertical direction (an arrow Z direction), is connected at an upper portion 20A side to an upper portion of the heat exchanger 10, and is fixed at a lower portion 20B side to the bottom plate 4 by bolts or the like.

Here, when the outdoor unit 100 performs a heating operation, the heat exchanger 10 serves as an evaporator and removes heat from low-temperature ambient air. Thus, frost may occur on the heat exchanger 10 depending on the ambient air condition. The occurrence of frost inhibits heat exchange between the refrigerant and the ambient air, and thus a defrost operation is performed in which, for example, a warm refrigerant flows into the heat exchanger 10. Then, the frost attached to the heat exchanger 10 is melted and flows out as drain water, and the drain water is discharged through a drain discharge hole provided in the bottom plate 4. At that time, in a cold climate area, there is a concern that an adverse effect occurs, for example, drain water or the like freezes and closes the discharge hole, or ice grows to tilt down the fin of the heat exchanger 10 or come into contact with the propeller 11*a*. Thus, the outdoor unit 100 includes a heater 12 which heats the bottom plate 4 for preventing drain water from freezing during a defrost operation.

The heater 12 is, for example, a sheathed heater in which a nichrome wire is enclosed in a metal pipe, and is disposed on the bottom plate 4. The heater 12 is formed in a tubular shape and bent into any shape according to the shape of the bottom plate 4. The heater 12 needs to be fixed while being pressed with a constant force, in order to prevent its positional displacement or contact with another component from occurring due to vibrations or collision during conveyance of the outdoor unit 100. Thus, a structure is provided in which the heater 12 is fixed by a heater fixture 40 and the heater fixture 40 is fixed to the fan retaining portion 20.

Specifically, as shown in FIG. 3, a mounting portion 30 for mounting the heater fixture 40 is provided at the lower portion 20B of the fan retaining portion 20, and the heater fixture 40 is fixed to the mounting portion 30.

Figure 4:
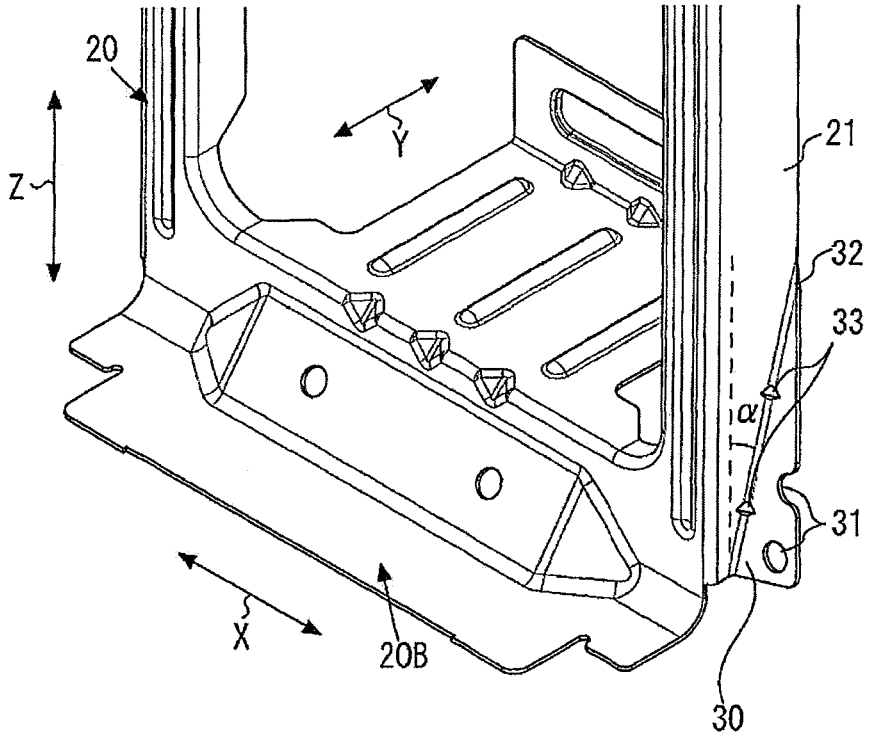
FIG. 4 is a perspective view showing a region around a mounting portion of the fan retaining portion in FIG. 3.

FIG. 4 is a perspective view showing in an enlarged manner a region around the mounting portion 30 in the fan retaining portion in FIG. 3. As shown in FIG. 4, the mounting portion 30 is formed in a plate shape and provided at the lower portion 20B of the fan retaining portion 20. The mounting portion 30 has holes 31 for inserting fastening members 60 such as bolts (see FIGS. 6 and 7). The mounting portion 30 is formed by bending an end portion of a side plate (XY plane) of the support 21 toward the front surface side (XZ plane side), and triangular beads 33 for enhancing strength are disposed at a bent portion 32.

Here, the mounting portion 30 is formed so as to be directed upward at an inclination angle $\alpha$ relative to a direction perpendicular to the bottom plate 4 (an XZ plane). It is possible to appropriately set the inclination angle $\alpha$ within a range of 0 degrees$\leq\alpha\leq$90 degrees, and the inclination angle $\alpha$ more preferably meets 10 degrees$\leq\alpha\leq$20 degrees. It should be noted that $\alpha$ may be 0 degrees (parallel to the XZ plane). However, in the case of the inclination angle $\alpha<10$ degrees, the mounting portion 30 is formed on substantially a vertical surface (on an YZ plane). Thus, it is difficult for a worker to perform installation in fixing with the fastening members 60, and a finger or the like may come into contact with an end surface of the bottom plate 4. On the other hand, in the case of $\alpha>20$ degrees, the surface area of the mounting portion 30 is decreased, and bolt fixing at two locations becomes difficult. In consideration of these factors, when the mounting portion 30 is formed by bending, the inclination angle $\alpha$ more preferably meets 10 degrees$\leq\alpha\leq$20 degrees. Thus, at the time of installation, the worker is allowed to perform the assembling in a proper posture, and it is possible to reliably prevent a finger or the like from coming into contact with the end surface of the bottom plate 4.

Figure 5:
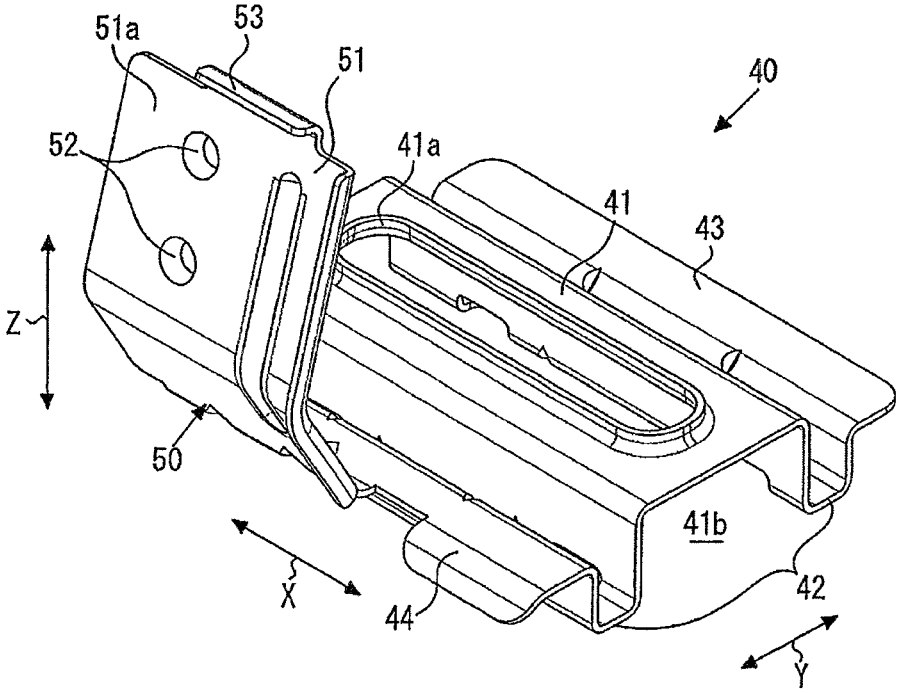
FIG. 5 is a perspective view showing an example of the heater fixture in FIG. 3.

FIG. 5 is a perspective view showing an example of the heater fixture 40 in FIG. 3. The heater fixture 40 in FIG. 5 is formed, for example, by press working, and includes a base 41, leg portions 42, pressing portions 43 and 44, and a connection portion 50. The base 41 is a flat plate-shaped member and has an elongate circular opening 41*a* at its center. The opening 41*a* allows drain water dropped from the heat exchanger 10 above the base 41 to flow therethrough to the bottom plate 4 side without staying, thereby suppressing growth of ice. It should be noted that for enhancing strength, a rising portion is formed at the periphery of the opening 41*a* by burring. In addition, the leg portions 42 brought into contact with the bottom plate 4 are provided at the base 41. A hollow portion 41*b* is formed between the base 41 and the bottom plate 4 by the leg portions 42. Thus, it is possible to reliably allow drain water to flow from the opening 41*a* through the hollow portion 41*b* to the discharge hole.

In addition, the pressing portions 43 and 44 for pressing the heater 12 from above are provided at both ends of the base 41. The pressing portions 43 and 44 are formed, for example, in a plate shape, and serve to fix the heater 12 by coming into contact with and pressing the upper portion of the heater 12. Furthermore, at the other end side of the base 41, the connection portion 50 is provided so as to extend toward the mounting portion 30.

The connection portion 50 is a member extending from the end portion of the base 41 toward the mounting portion 30, and includes a flat plate 51 connected to the mounting portion 30. It should be noted that the flat plate 51 of the connection portion 50 is bent at such an angle as to be in close contact with the mounting portion 30, and has a positioning piece 53 and holes 52 for inserting the fastening members 60. The fastening members 60 are inserted into the holes 52 and tightened, whereby the heater fixture 40 is fixed to the mounting portion 30. The positioning piece 53 is formed in a projection shape on a contact surface 51*a* with the mounting portion 30 for positioning relative to the mounting portion 30. The positioning piece 53 is formed in a projection shape with respect to the contact surface, for example, by bending the upper end portion of the connection portion 50 toward the front surface side. When the connection portion 50 is positioned relative to the mounting portion 30, the end portion of the positioning piece 53 comes into contact with the edge of the mounting portion 30, whereby the holes 31 of the mounting portion 30 and the holes 52 of the connection portion 50 are positioned.

Figure 6:
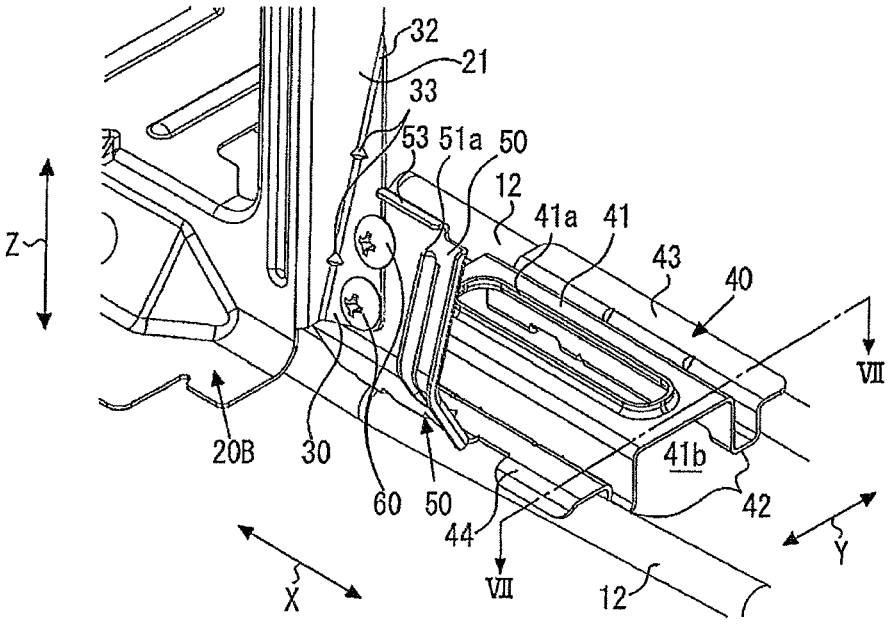
FIG. 6 is a schematic diagram showing a situation where the heater fixture is mounted on the fan retaining portion.
Figure 7:
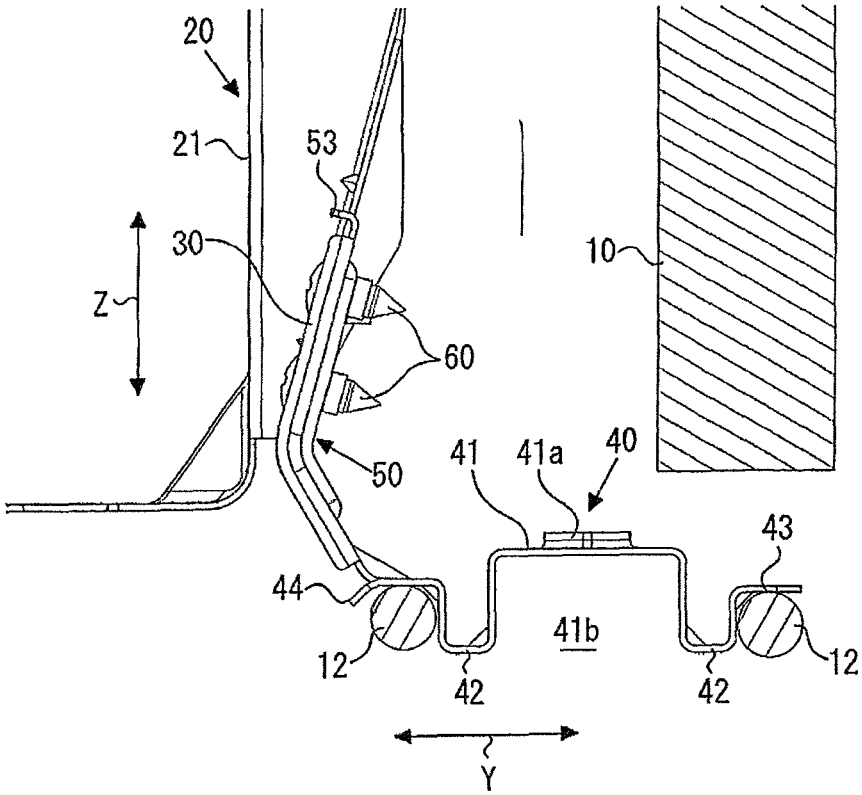
FIG. 7 is a cross-sectional view showing a VII-VII cross-section of FIG. 6.

FIG. 6 is a perspective view showing a situation where the heater fixture is mounted on the fan retaining portion, and FIG. 7 is a cross-sectional view showing a VII-VII cross-section of FIG. 6. As shown in FIGS. 6 and 7, first, the heater 12 is placed on the bottom plate 4, and the fan retaining portion 20 is fixed at its lower portion 20B. In this state, the heater fixture 40 is placed such that the heater 12 is located below the pressing portions 43 and 44. Then, the heater fixture 40 is slid in an arrow X direction such that the connection portion 50 is located below the mounting portion 30, and the mounting portion 30 and the connection portion 50 are adjusted in position relative to each other. At that time, the heater fixture 40 is slid laterally until the positioning piece 53 comes into contact with the edge of the mounting portion 30, whereby it is possible to easily perform the positioning, and thus it is possible to improve the workability at the time of installation. Then, the fastening members 60 such as bolts are inserted into the holes 31 and the holes 52, and the fan retaining portion 20 and the heater fixture 40 are fixed to each other. At that time, since the mounting portion 30 and the flat plate 51 of the connection portion 50 face toward the front surface side and are directed upward at the inclination angle α, the worker is allowed to easily perform the installation with the fastening members 60.

According to the above-described embodiment, since the heater fixture 40 is fixed to the fan retaining portion 20, not to the bottom plate 4, the bolt ends at the heater fixture 40 are not exposed to the outside of the outdoor unit 100, and it is possible to prevent the bolt ends from coming into contact with a finger of the worker. It should be noted that the ends of the fastening members 60 which fasten the fan retaining portion 20 and the heater fixture 40 are exposed inside the outdoor unit 100 but are not brought into contact with a finger of the worker, since the heat exchanger 10 is located at the back side.

In addition, in the case where the heater fixture 40 is fixed to the bottom plate 4, when the outdoor unit 100 is mounted so as to be hung from a ceiling, for example, at a balcony of a condominium or an apartment, the bolt ends protrude from the lower side of the bottom plate 4. Thus, the appearance and the design or the bolt ends themselves make a resident feel uncomfortable. Meanwhile, it is possible to provide the outdoor unit 100 of the air-conditioning apparatus in which when the outdoor unit 100 is mounted so as to be hung from a ceiling, the ends of the bolts are not seen by a resident and do not make the resident feel uncomfortable.

Furthermore, the mounting portion 30 and the connection portion 50 are shaped to be inclined relative to the front surface (the XZ plane). Thus, at the time of installation, the worker is allowed to perform the installation operation from the front surface side in a proper posture, and there is no concern that a finger or the like comes into contact with the end surface of the bottom plate 4. Thus, even after installation of the heat exchanger 10, it is made possible to easily dispose the heater 12 therein, whereby it is possible to improve the workability at the time of a line operation or in mounting the heater 12 after installation due to separate selling of them. Moreover, it is unnecessary to provide a screw cover for covering bolts protruding from the lower side of the bottom plate 4 as in the related art, and it is possible to enhance the efficiency of the assembling operation and reduce the number of components of the outdoor unit 100.

The embodiment of the present invention is not limited to the above-described embodiment. For example, the case where the heater fixture 40 is fixed to the mounting portion 30 provided at the fan retaining portion 20 has been illustrated in the above-described embodiment, but the heater fixture 40 may have any structure as long as it is fixed to the fan retaining portion. It is possible to employ various methods of connecting two members such as being fixed to the support 21 of the fan retaining portion 20. In addition, the case where the mounting portion 30 is formed as a flange by cutting and bending upward a part of the support 21 of the fan retaining portion 20 has been illustrated, but the mounting portion 30 may be provided by additionally fixing a rib or the like to the fan retaining portion 20.

Furthermore, the case where the pressing portions 43 and 44 of the heater fixture 40 are formed in a flat shape has been illustrated in the above-described embodiment, but the pressing portions 43 and 44 may have, for example, a curved surface shape along the outer shape of the heater 12.

Moreover, the case is illustrated in which the positioning piece 53 comes into contact with the edge of the mounting portion 30, thereby positioning the heater fixture. However, a cut for fitting the positioning piece 53 thereto may be formed at the edge of the mounting portion 30.

[Reference Signs List]

1: top panel, 2 front panel, 3: side panel, 4: bottom plate, 4*k* leg portion, 5: separator, 6: compressor, 7: refrigerant pipe, 8: electrical component box, 10: heat exchanger, 11: fan, 11*a*: propeller, 11*b*: motor, 12: heater, 20: fan retaining portion, 20A: upper portion, 20B: lower portion, 21: support, 30: mounting portion, 31: hole, 32: bent portion, 33: triangular bead, 40: heater fixture, 41: base, 41*a*: opening, 41*b*: hollow portion, 42: leg portion, 43, 44: pressing portion, 50: connection portion, 51: flat plate, 51*a*: contact surface, 52: hole, 53: positioning piece, 60: fastening member, 100: outdoor unit, MR: machine room, WR: fan room, α: inclination angle

The invention claimed is:

1. An outdoor unit of an air-conditioning apparatus including a bottom plate, a heat exchanger mounted on the bottom plate, and a fan sending air to the heat exchanger, the outdoor unit comprising: a heater provided on the bottom plate; a fan retaining portion, mounted on the bottom plate, configured to retain the fan; and a heater fixture, mounted on the fan retaining portion, configured to fix the heater by pressing the heater against the bottom plate from above, wherein a mounting portion that mounts the heater fixture is provided at the fan retaining portion and is formed by bending a part of the fan retaining portion, wherein the mounting portion is a flat plate which faces toward a front surface side that is a surface opposed to the heat exchanger and which is inclined so as to face upward, and wherein the mounting portion is inclined upward such that an inclination angle alpha thereof relative to a direction perpendicular to the bottom plate meets 10 degrees $\leq\alpha\leq$20 degrees.

2. The outdoor unit of the air-conditioning apparatus of claim 1, wherein the heater fixture includes a base, a pressing portion provided at an end portion of the base and located at an upper portion of the heater, and a connection portion extending from the end portion of the base toward the mounting portion.

3. The outdoor unit of the air-conditioning apparatus of claim 2, wherein a projection-shaped positioning piece is provided on a contact surface of the connection portion with the mounting portion for positioning relative to the mounting portion.

* * * * *